US006435436B1

(12) United States Patent
Auten

(10) Patent No.: US 6,435,436 B1
(45) Date of Patent: Aug. 20, 2002

(54) YARN CARRIER HAVING AN ANNULAR RECESS CONTAINING MARKINGS FOR YARN IDENTIFICATION

(75) Inventor: John F. Auten, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/536,132

(22) Filed: Mar. 28, 2000

(51) Int. Cl.[7] ..... B65H 75/12; B65H 65/00; G09F 3/00

(52) U.S. Cl. ..... 242/118.32; 242/476.5; 40/309

(58) Field of Search ..... 242/118.32, 476.5, 242/476.6, 473.8, 118.3; 40/309

(56) References Cited

U.S. PATENT DOCUMENTS

| | | | | |
|---|---|---|---|---|
| 1,187,594 | A | | 6/1916 | Zumvorde |
| 1,458,587 | A | | 6/1923 | McKean |
| 1,588,259 | A | | 6/1926 | Morrell |
| 2,327,738 | A | | 8/1943 | Perry |
| 2,430,710 | A | | 11/1947 | Dunlap |
| 2,630,976 | A | | 3/1953 | Keight |
| 2,875,961 | A | | 3/1959 | Mori et al. |
| 2,958,145 | A | | 11/1960 | Curry |
| 3,018,973 | A | | 1/1962 | Bradley |
| 3,034,743 | A | | 5/1962 | Hill |
| 3,210,922 | A | | 10/1965 | Winter |
| 3,284,023 | A | | 11/1966 | Sowell |
| 3,380,238 | A | | 4/1968 | Araki et al. |
| 3,450,370 | A | | 6/1969 | Hawkins |
| 3,488,010 | A | | 1/1970 | Parry |
| 3,530,657 | A | | 9/1970 | Grau |
| 3,631,663 | A | | 1/1972 | Krauss et al. |
| 3,658,275 | A | | 4/1972 | Lahmann |
| 3,731,479 | A | | 5/1973 | Flowers et al. |
| 3,752,414 | A | | 8/1973 | Urquhart |
| 3,876,165 | A | | 4/1975 | Comer |
| 3,910,513 | A | | 10/1975 | Gelin et al. |
| 3,967,795 | A | | 7/1976 | Shindo et al. |
| 4,050,645 | A | | 9/1977 | Burchette, Jr. et al. |
| 4,055,311 | A | * | 10/1977 | Bock et al. ..... 242/118.3 X |
| 4,057,201 | A | | 11/1977 | Wilkinson |
| 4,184,653 | A | | 1/1980 | Bonzo |
| 4,351,491 | A | | 9/1982 | Hill, Jr. |
| 4,390,144 | A | | 6/1983 | Mueller |
| 4,462,556 | A | | 7/1984 | Graham, Jr. |
| 4,596,366 | A | | 6/1986 | Dick et al. |
| 4,660,370 | A | * | 4/1987 | Matsui et al. ..... 242/470 X |
| 4,723,405 | A | | 2/1988 | Shinkai et al. |
| 4,760,976 | A | | 8/1988 | Burchette, Jr. |
| 4,842,213 | A | | 6/1989 | Bärtschi et al. |
| 4,852,823 | A | | 8/1989 | Adams et al. |
| 4,889,294 | A | | 12/1989 | Adams et al. |
| 4,901,941 | A | | 2/1990 | Powel et al. |
| 4,919,359 | A | | 4/1990 | Powel et al. |
| 4,936,523 | A | | 6/1990 | Powel et al. |

(List continued on next page.)

FOREIGN PATENT DOCUMENTS

| | | |
|---|---|---|
| CA | 664702 | 6/1963 |
| GB | 778375 | 7/1957 |
| GB | 834193 | 5/1960 |
| GB | 1341034 | 12/1973 |
| PK | 111453 | 8/1960 |
| RU | 654522 | 3/1979 |

*Primary Examiner*—Michael R. Mansen
(74) *Attorney, Agent, or Firm*—Drinker Biddle & Reath LLP

(57) ABSTRACT

A re-usable yarn carrier includes a tube having an annular recess formed in an outer peripheral surface adjacent one end of the tube. The annular recess defines a marking surface located radially inward from the outer peripheral surface. The marking surface includes markings, for example, colored bands, bar code or the like, for identifying at least one characteristic of the yarn wound onto the carrier. The marking surface may further include a knurled surface, slip-resistant coating, hooks or the like, for catching the yam at the start of the winding operation.

18 Claims, 4 Drawing Sheets

U.S. PATENT DOCUMENTS 5,036,656 A * 8/1991 Erni et al. ..... 57/264
5,071,081 A 12/1991 Scaglia
5,211,354 A 5/1993 Rummage
5,279,729 A * 1/1994 Tone et al. ..... 209/556
5,328,121 A 7/1994 Rummage
5,441,208 A 8/1995 Millen et al.
5,465,916 A 11/1995 König
5,479,770 A 1/1996 Bothner et al.
5,581,989 A 12/1996 Mann et al.
6,073,868 A * 6/2000 Stevens et al. ..... 242/118.32

* cited by examiner

YARN CARRIER HAVING AN ANNULAR RECESS CONTAINING MARKINGS FOR YARN IDENTIFICATION

FIELD OF THE INVENTION

The present invention relates generally to a yarn carrier and, in particular, to a yarn winding tube for high speed winding operations. The present invention includes a re-useable tube having yarn identifying markings disposed on a recessed surface.

BACKGROUND OF THE INVENTION

During the yarn manufacturing process, yarn packages are formed by winding yarn onto yarn carriers that are rotated at high speeds, sometimes in excess of 8,000 rpms. Typically, the yarn carrier is rotated by a drive mechanism that includes a driven roller which contacts the outer surface of the carrier at the start of winding and drives the carrier through frictional engagement between the driven roller and the carrier. As layers of yarn are wound onto the carrier, the driven roller moves radially outward from the carrier, maintaining frictional contact with the outer layer of yarn. A pick-up groove is usually provided at one end of the tube for capturing the yarn and initiating the winding of the yarn onto the tube.

These yarn winding tubes are often made of paperboard or other fibrous materials such as those disclosed in U.S. Pat. Nos. 4,057,201 And 5,328,121.

The life of a laminated paper yarn tube is somewhat limited. Paper tubes are often damaged during shipments and/or winding of the yarn. Disfiguration of the tube may cause uneven rotation during the yarn winding operation. Moisture absorption by the paper tube may also cause changes in dimension and other physical properties. Furthermore, paper tends to create dust, particularly when the driven roller is in contact with the carrier at the start of winding.

Plastic, re-useable winding tubes have been suggested as replacements for paper carriers. Examples of re-useable winding tubes are shown in U.S. Pat. Nos. 4,889,294 and 4,901,941.

One important features of a yarn winding tube is the means for identifying the particular type of yarn on the tube without a detailed inspection of the yarn. A visual symbol or identification mark is often applied to the rim of the tube, above the yarn wound thereon. These markings may be a printed symbol on the ends of the tube. A particularly useful means for yarn identification is to color code the carriers with one or more colored bands on their outer peripheral surfaces. Multiple bands are preferred because they can convey more information than a single colored band. For example, one band may be used to designate the yarn material and another may be used to designate the denier of the yarn. Moreover, providing various combinations of colors allows a greater number of yarns to be identified than if one band were used.

Placing yarn identifying markings on the outer peripheral surface of the carrier, however, exposes them to significant wear from frictional contact with the driven roller during the start of the winding operation, the winding of the first layer of yarn onto the carrier, an handling of carrier while empty. The wearing away of the markings can produce dust that could contaminate the yarn and could collect on the parts of the winding machine, which would require more frequent maintenance and may be more prone to failure. In addition, after prolonged use, the markings may wear away completely, requiring the markings to be reapplied or new carriers to be provided more often than desired.

SUMMARY OF THE INVENTION

The present invention is directed to a yarn carrier adapted to be mounted on a winding machine, to have yarn wound thereon and unwound therefrom, and to form a yarn package. The yarn carrier comprises a tube having a first end, a second end and an outer peripheral surface located between the first and second ends. The tube includes a recess formed in the outer peripheral surface that defines a marking surface located radially inward from the outer peripheral surface. The tube further includes at least one marking disposed on the marking surface that is adapted to identify at least one characteristic of the yarn wound onto the carrier.

In another aspect, the yarn carrier of the present invention may include a yarn catching means located in the recess. The yarn catching means may include a roughened portion of the marking surface, slip-resistant coating, a strip having a plurality of hooks or the like.

BRIEF DESCRIPTION OF THE DRAWINGS

For the purpose of illustrating the invention, there is shown in the drawings a form which is presently preferred. It should be understood, however, that the invention is not limited to the precise arrangements and instrumentalities shown.

DETAILED DESCRIPTION OF THE DRAWINGS

Figure 1:
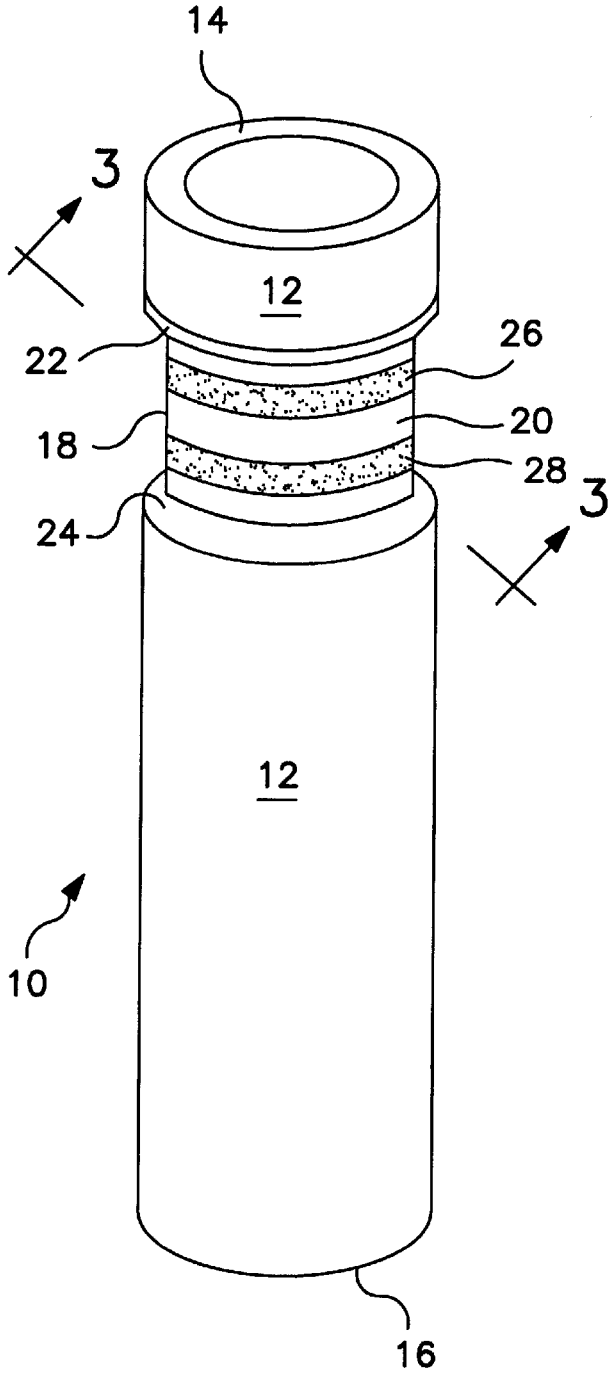
FIG. 1 is a perspective view of a yarn winding tube according to the present invention.

Referring now to the drawings, where like numerals indicate like elements, there is shown a tube-type yarn carrier, which is generally designated by the numeral 10. As illustrated in FIG. 1, the carrier 10 is a hollow, elongated tubular body made of plastic or other durable material. Although illustrated as being a cylindrical shape, it should be appreciated that the carrier could also have a frusto-conical shape or any shape that may be rotated at a high rate of speed. The carrier 10 has an outer peripheral surface 12 for receiving yarn thereon to form a yarn package. A first end 14 and a second end 16 are positioned opposite one another with the outer surface 12 located therebetween.

Figure 3:
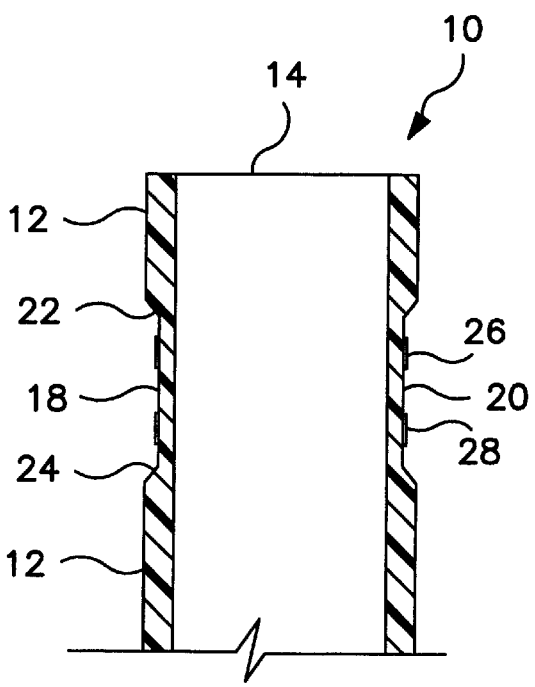
FIG. 3 is a partial cross-sectional view of the winding tube as taken along line 3—3 in FIG. 1.

As shown in cross-section in FIG. 3, an annular recess 18 is formed adjacent the first end 14 of the carrier 10. The recess 18 has a marking surface 20 positioned radially inward of the outer surface 12 of the carrier 10. Preferably, the marking surface is parallel to the outer surface. A pair of shoulders 22, 24 extend inwardly from the outer surface 12 to the marking surface 20. As illustrated, the shoulders 22, 24 are sloped with respect to the marking surface 20 of the recess 8. However, the relative angle of the shoulder surface may vary if desired.

As illustrated in FIG. 1, the marking surface 20 contains two circumferential colored bands 26, 28 that indicate one or more characteristics of the yarn wound onto the carrier. For example, the upper band 26 may be designated to indicate the material the yarn is made of and the lower band 28 may be designated to indicate the denier of the yarn. Alternatively, the combination of the colors of the two bands may be designated to indicate only one characteristic of the yarn, such as its denier. Other characteristics of the yarn may be indicated using more bands and/or different combinations of colors. The width of the recess 18 may be any width desired. However, it is preferred that the width be limited to that necessary to contain the markings.

Figure 1A:
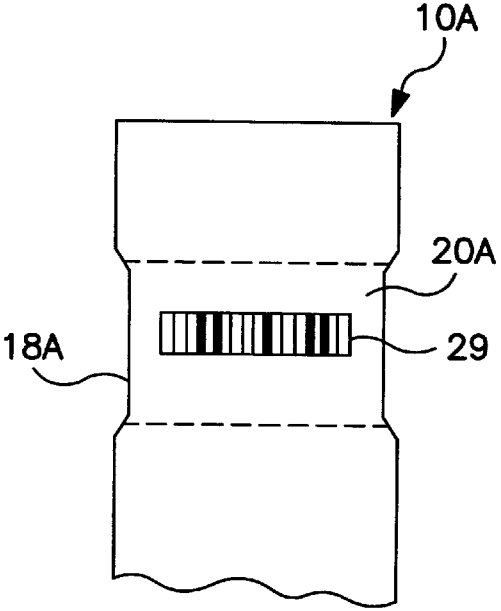
FIG. 1A is a partial elevational view of a yam winding tube according to an embodiment of the present invention having bar coding as identifying marking.

Although colored bands are shown, the yarn identification markings may be any desired, such as alpha-numeric codes, bar codes, colored segments or the like. Referring to FIG. 1A, there is shown a yarn tube 10A having a marking surface 20A defined by a recess 18A. The yarn tube 10A includes identification markings on the marking surface that consist of bar coding 29. Moreover, the recess need not be annular. It may be another shape, such as a half annulus formed on one of half of the circumference of the carrier. However, an annular recess having annular colored bands is preferred because the markings are visible regardless of the rotated position of the carrier about it longitudinal axis.

The yarn identification markings may be printed on the marking surface 20 with ink, paint or other coating. Alternatively, the markings may comprise strips of adhesive tape, bands of heat shrinkable material or the like, applied to the marking surface.

Figure 2:
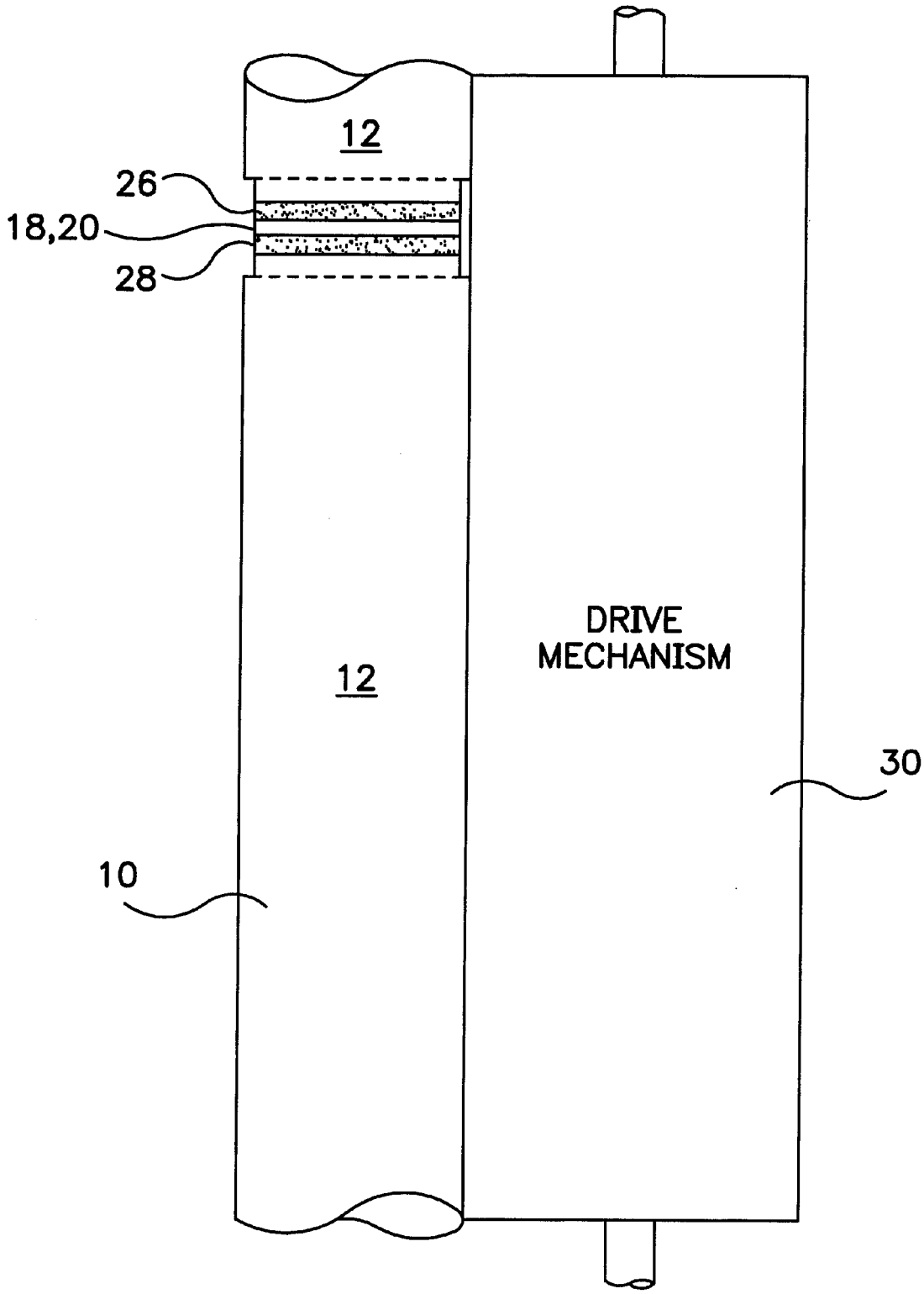
FIG. 2 is an elevational view of the winding tube of FIG. 1 in contact with a driven roller of a winding machine.

As illustrated in FIG. 2, a driven roller 30 of a drive mechanism is brought into contact with the outer peripheral surface of the carrier 10 at the start of the winding operation. The driven roller 30 rotates the carrier 10 through frictional contact between the roller 30 and carrier 10. While the carrier 10 is rotated, a strand of yarn is brought into contact with the carrier 10 and the yarn is wound thereon. As the yam is wound onto the carrier 10 and builds up into layers, the driven roller 30 is maintained in contact with the outer layer of yarn to keep the carrier rotating. During the initial phase of winding when the driven roller is rotating the carrier without any yarn wound thereon, the recessed markings are protected from being worn away or otherwise damaged by the driven roller. Moreover, the recessed markings are protected from damage as the yarn is wound onto the carrier, the carrier is handle while empty or the like.

Figure 6:
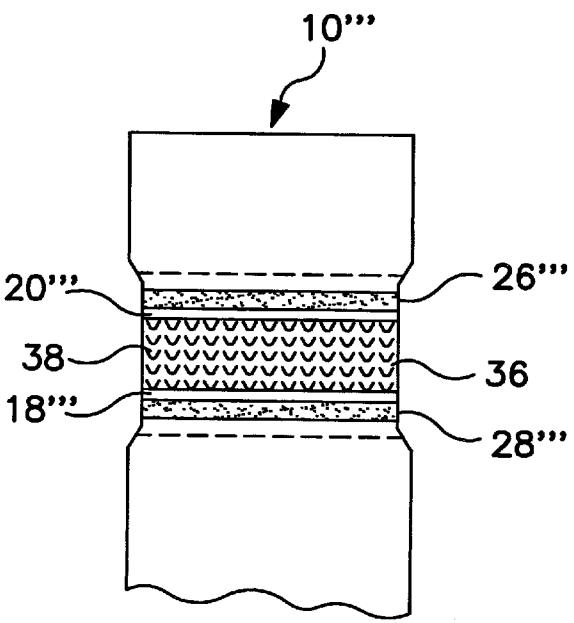
FIG. 6 a partial elevational view of a yarn winding tube according to an embodiment of the invention having a strip carrying a plurality of hooks.
Figure 5:
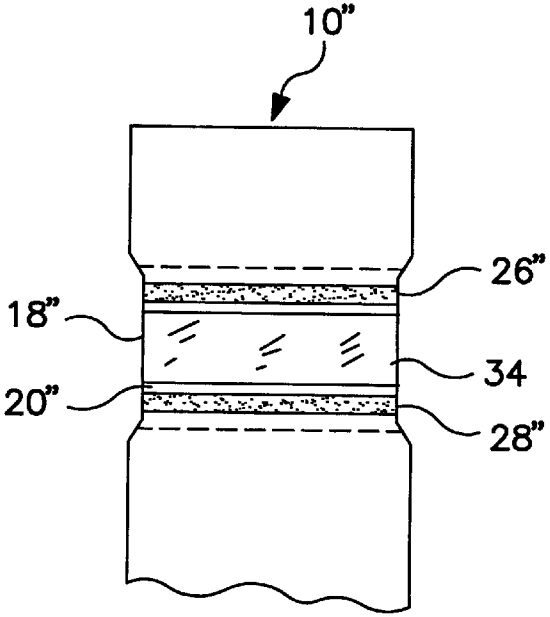
FIG. 5 is a partial elevational view of a yarn winding tube according to an embodiment of the invention having a slip-resistant coating.
Figure 4:
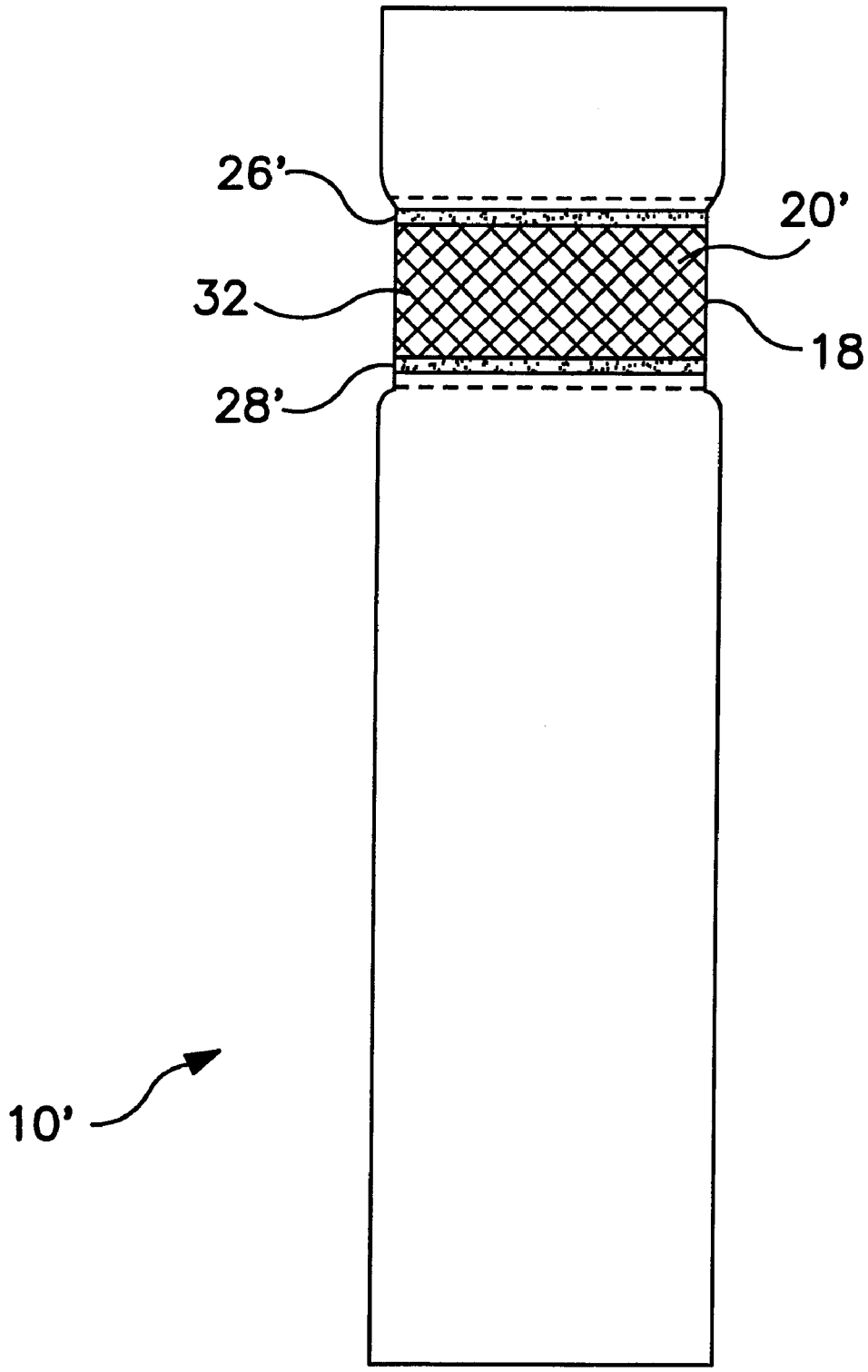
FIG. 4 is an elevational view illustrating an alternative embodiment of the winding tube according to the present invention.

FIG. 4 shows an alternative embodiment of the yarn carrier 10' of the present invention. In this embodiment, the marking surface 20' includes a yarn catching means in addition to the yarn identification markings. The yarn catching means is used to catch a strand of yarn during the start of the winding operation. In the embodiment shown, the yam catching means comprises a roughened, or knurled, portion 32 of the recessed marking surface 20'. Two colored yarn identification bands 26', 28' are located adjacent the knurled portion 32. Alternatively, the yarn catching means may comprise an anti-slip coating 34 as shown on the yarn tube 10" of FIG. 5. The anti-slip coating 34 is located on the marking surface 20" defined by recess 18" between colored bands 26", 28". The yarn catching means may also comprise a plurality of hooks (such as those comprising VELCRO® brand hook and loop fastener) or the like as shown on the yarn carrier 10''' of FIG. 6. The yarn carrier 10''' includes a strip 36 having a plurality of hooks 38 on a marking surface 20''' defined by recess 18'''. The strip 36 is located between colored bands 26''', 28'''. Similar to the yarn identification markings, the yarn catching means are protected from wear by virtue of their placement in the recesses 18', 18" and 18'''.

The invention has been described with respect to a yam carrier. However, one skilled in the art will readily appreciate that the present invention may be used for other types of material suitable for being wound onto a carrier, such as various types of rope, wire, cable, mono-filaments and the like.

Although the invention has been described and illustrated with respect to the exemplary embodiments thereof, it should be understood by those skilled in the art that the foregoing and other various changes, omissions and additions may be made therein and thereto, without parting from the spirit and scope of the present invention.

What is claimed is:

1. A yarn carrier adapted to be mounted on a winding machine, to have yarn wound thereon and unwound therefrom, and to form a yarn package, the yarn carrier comprising:

a tube, the tube having a first end, a second end and an outer peripheral surface located between the first and second end, the tube including a recess formed in the outer peripheral surface, the recess defining a marking surface located radially inward from the outer peripheral surface; and at least one marking disposed on the marking surface, the marking adapted to identify at least one characteristic of the yarn wound onto the carrier, the at least one marking having at least one exposed surface, all of the exposed surfaces of the at least one marking being located radially inward from the outer peripheral surface.

2. The yarn carrier of claim 1 wherein the recess is continuous around the outer peripheral surface of the carrier.

3. The yarn carrier of claim 2 wherein the tube is cylindrical and the recess is annular in shape.

4. The yarn carrier of claim 2 wherein the marking comprises a colored band extending around the periphery of the marking surface.

5. The yarn carrier of claim 2 wherein the makings comprise two colored bands extending around the periphery of the marking surface.

6. The yarn carrier of claim 1 wherein the marking comprises a bar code.

7. The yarn carrier of claim 1 further comprising a yarn catching means located within the recess.

8. The yarn carrier of claim 7 wherein the yarn catching means comprises a roughened surface covering at least a portion of the marking surface.

9. The yarn carrier of claim 7 wherein the yarn catching means comprises a slip-resistant coating applied to at least a portion of the marking surface.

10. The yarn carrier of claim 7 wherein the yarn catching means comprises a flexible strip and plurality of hooks attached to the strip, the strip attached to at least a portion of the marking surface.

11. The yarn carrier of claim 1 wherein the tube is made of a thermoplastic material.

12. A yarn carrier adapted to be mounted on a winding machine, to have yarn wound thereon and unwound therefrom, and to form a yarn package, the yarn carrier comprising:

a tube having a circular cross-sectional shape, the tube including a first end, a second end and an outer peripheral surface located between the first and second end, the tube including a recess formed in the outer peripheral surface around the entire circumference of the carrier, the recess defining a marking surface located radially inward from the outer peripheral surface and including a first and second shoulder formed between the outer peripheral surface of the tube and the marking surface of the recess; and at least one marking disposed on the marking surface, the marking adapted to identify at least one characteristic of the yarn wound onto the carrier.

13. The yarn carrier of claim 12 wherein the at least one of the shoulders forms a gradual slope from the outer peripheral surface to the marking surface.

14. The yarn carrier of claim 12 wherein the marking comprises a colored band extending around the periphery of the marking surface.

15. A yarn carrier adapted to be mounted on a winding machine, to have yarn wound thereon and unwound therefrom, and to form a yarn package, the yam carrier comprising:

a tube having a circular cross-sectional shape, the tube including a first end, a second end and an outer peripheral surface located between the first and second end, the tube including a recess formed in the outer peripheral surface around the entire circumference of the carrier, the recess defining a marking surface located radially inward from the outer peripheral surface and including a first and second shoulder formed between the outer peripheral surface of the tube and the marking surface of the recess;

at least one marking disposed on the marking surface, the marking adapted to identify at least one characteristic of the yam wound onto the carrier; and a yarn catching means located within the recess.

16. The yarn carrier of claim 15 wherein the yarn catching means comprises a roughened surface covering at least a portion of the marking surface.

17. The yarn carrier of claim 15 wherein the yarn catching means comprises a slip resistant coating applied to at least a portion of the marking surface.

18. The yarn carrier of claim 15 wherein the yarn catching means comprises a flexible strip and plurality of hooks attached to the strip, the strip attached to at least a portion of the marking surface.

* * * * *